US005292047A

United States Patent [19]

Varidel

[11] Patent Number: 5,292,047

[45] Date of Patent: Mar. 8, 1994

[54] UNIVERSAL MOVABLE UPPER TOOL FOR A WASTE-STRIPPING STATION SITUATED WITHIN A SHEET DIE-CUTTING MACHINE USED FOR PRODUCING PACKAGES

[75] Inventor: Charly Varidel, Le Mont, Switzerland

[73] Assignee: Bobst SA, Switzerland

[21] Appl. No.: 684,837

[22] Filed: Apr. 15, 1991

[30] Foreign Application Priority Data

Apr. 26, 1990 [CH] Switzerland ..... 01431/90

[51] Int. Cl.[5] ..... B26F 3/02; B26D 7/02

[52] U.S. Cl. ..... 225/97; 225/103; 83/103; 83/132; 83/139; 83/142; 83/387; 83/389; 83/699

[58] Field of Search ..... 225/97, 93, 103; 24/306, 324, 442; 83/103, 139, 140, 132, 136, 142, 387, 389, 698, 699

[56] References Cited

U.S. PATENT DOCUMENTS

| | | | |
|---|---|---|---|
| 2,499,898 | 3/1950 | Anderson | 24/442 |
| 3,055,275 | 9/1962 | Schroter | 225/97 X |
| 3,101,517 | 8/1963 | Fox et al. | 24/442 |
| 3,133,467 | 5/1964 | Tauser | 83/138 X |
| 3,249,272 | 5/1966 | Scarda | 225/97 X |
| 3,469,289 | 9/1969 | Whitacre | 24/442 X |
| 3,568,903 | 3/1971 | Lang | 225/93 |

FOREIGN PATENT DOCUMENTS 490943 7/1970 Switzerland .

*Primary Examiner*—Eugenia Jones
*Assistant Examiner*—Raymond D. Woods
*Attorney, Agent, or Firm*—Hill, Steadman & Simpson

[57] ABSTRACT

A universal movable upper tool for a waste-stripping station situated within a machine designed for die-cutting sheet or web-like matter to be converted into packages includes a tool with a rectangular lower plate provided with apertures. Push-rods destined to push waste material through corresponding openings of a perforated upper plate forming a lower tool of the station are fitted against a lower side of the upper plate with the help of quick-fitting means situated on the upper plate's upper surface. Sponge rubber pressers are fitted against a lower side of the upper plate by means of strips affording an easily disengageable mechanical engagement such as hook and loop locking strips (such as VELCRO fasteners) or frictionally engaging locking devices (such as LEGO fasteners).

11 Claims, 2 Drawing Sheets

$S_1$
$S_1$
10
10
7
7
$P_1$
$P_1$
3
3
2
1
1
1
8
8
7
8'
7'
$E_1$
$E_1$
$E_1$
$E_1$
25'

FIG. 2
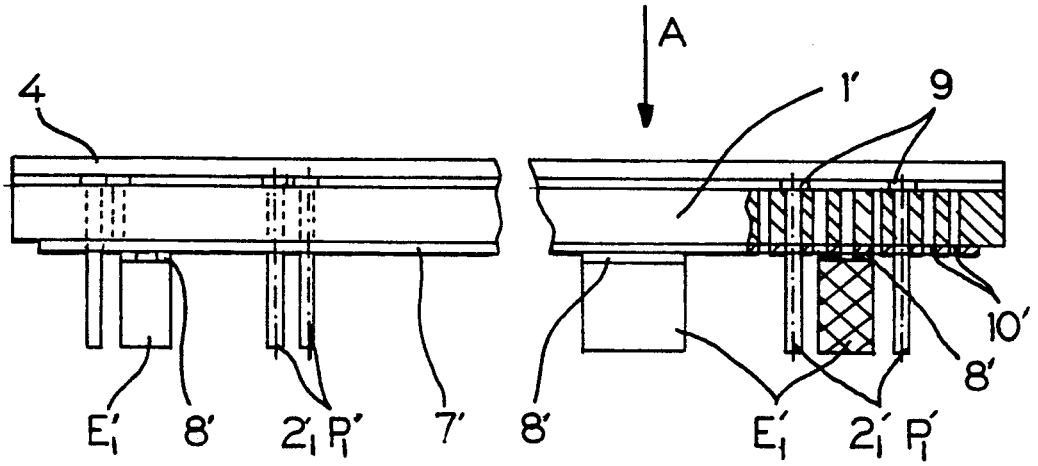
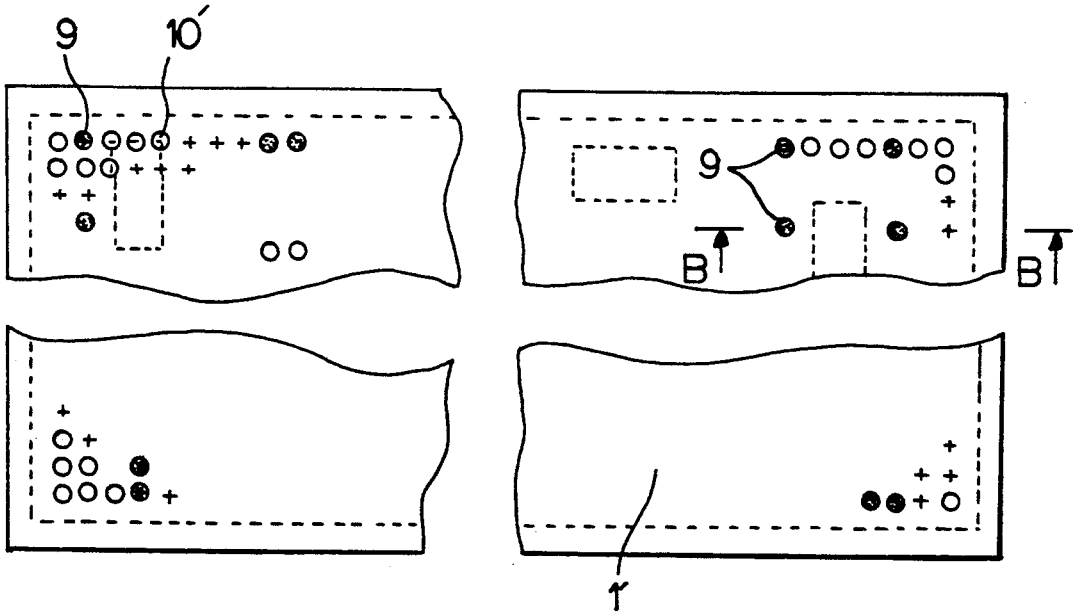
FIG. 3

UNIVERSAL MOVABLE UPPER TOOL FOR A WASTE-STRIPPING STATION SITUATED WITHIN A SHEET DIE-CUTTING MACHINE USED FOR PRODUCING PACKAGES

BACKGROUND OF THE INVENTION

The present invention relates to a movable upper tool for a waste-stripping station situated within a machine designed for die-cutting sheet or web-like matter to be converted into packages.

In the course of the production of packages, sheets are fed one by one into a die-cutting press. When the die-cutting operation is accomplished, every sheet has the shape of several cuttings or blanks juxtaposed and attached together with linking points which will be subsequently eliminated, every blank corresponding to a package. However, the blanks do not cover the whole surface of the sheet; in fact, certain areas situated between two blanks or at the periphery of the sheet are waste which have to be removed from the said sheet. For this purpose, every sheet having passed through the die-cutting station is fed individually into a waste-stripping station. This station includes a movable upper tool provided with push-rods, and a lower tool shaped as a perforated plate. With the sheet having been placed on the lower tool so as to undergo the waste-stripping operation, the upper tool is then lowered, thereby allowing the push-rods to press the waste through the corresponding apertures of the perforated plate.

In order to maintain the sheet in position and applied against the perforated plate during the waste-stripping operation, the prior art suggests to fit on the upper tool pressers made out of sponge rubber or similar material.

It is known to make so called universal tools, that is, tools which are able to be adjusted to various arrangements and configurations of the sheet's waste. Such a universal upper tool, as described for example in the Swiss patent CH-A-490943, consists of a horizontal plate with a size at least equivalent to the size of the sheet and perforated with numerous oblong apertures through every one of which a waste portion of the sheet may be pushed in between a push-rod fixed on the lower side of the plate and quick-fitting means arranged on the upper side of the same plate. By choosing the appropriate oblong apertures, and moving the push-rods along the latter apertures, it is possible to adapt the upper tool to every new job with only one plate and an adequate number of push-rods.

Until now, the fitting of the sponge rubber pressers against the lower side of the upper tool has been accomplished with the use of glue. Gluing, though, has the following drawbacks:

destruction of the pressers when removing them;

impossibility of fine adjustment of the position of the presser once in place; and Necessity to clean the plate.

For this reason, it has been suggested to replace the glue with a double-side adhesive which has nearly the same drawbacks as the glue.

SUMMARY OF THE INVENTION

Therefore, the object of the present invention is to provide an upper tool which possesses none of the above-mentioned drawbacks.

To achieve this object, a universal movable upper tool for a waste-stripping station, situated within a machine designed for die-cutting sheet or web-like matter used for producing packages includes a support on which stripping push-rods and elastic pressers are secured, and is provided with complementary mechanical retaining strips applied on every presser and on the support to removably secure the pressers to the support. The mechanical retaining strips can be a hook and loop type fastener system, such as that sold under the trademark "VELCRO", or could be a frictional engagement locking type fastener, such as that sold under the trademark "LEGO".

BRIEF DESCRIPTION OF THE DRAWINGS

Other characteristics and advantages of the invention will be apparent in light of the embodiments disclosed hereafter in order to ease the understanding with reference to the enclosed drawings, in which:

FIG. 2 is a side view (partial section according to B—B of FIG. 3) of an alternate embodiment of the upper tool;

FIG. 3 is a top view according to A of FIG. 2;

DESCRIPTION OF THE PREFERRED EMBODIMENTS

Figures 1, 4, 5:
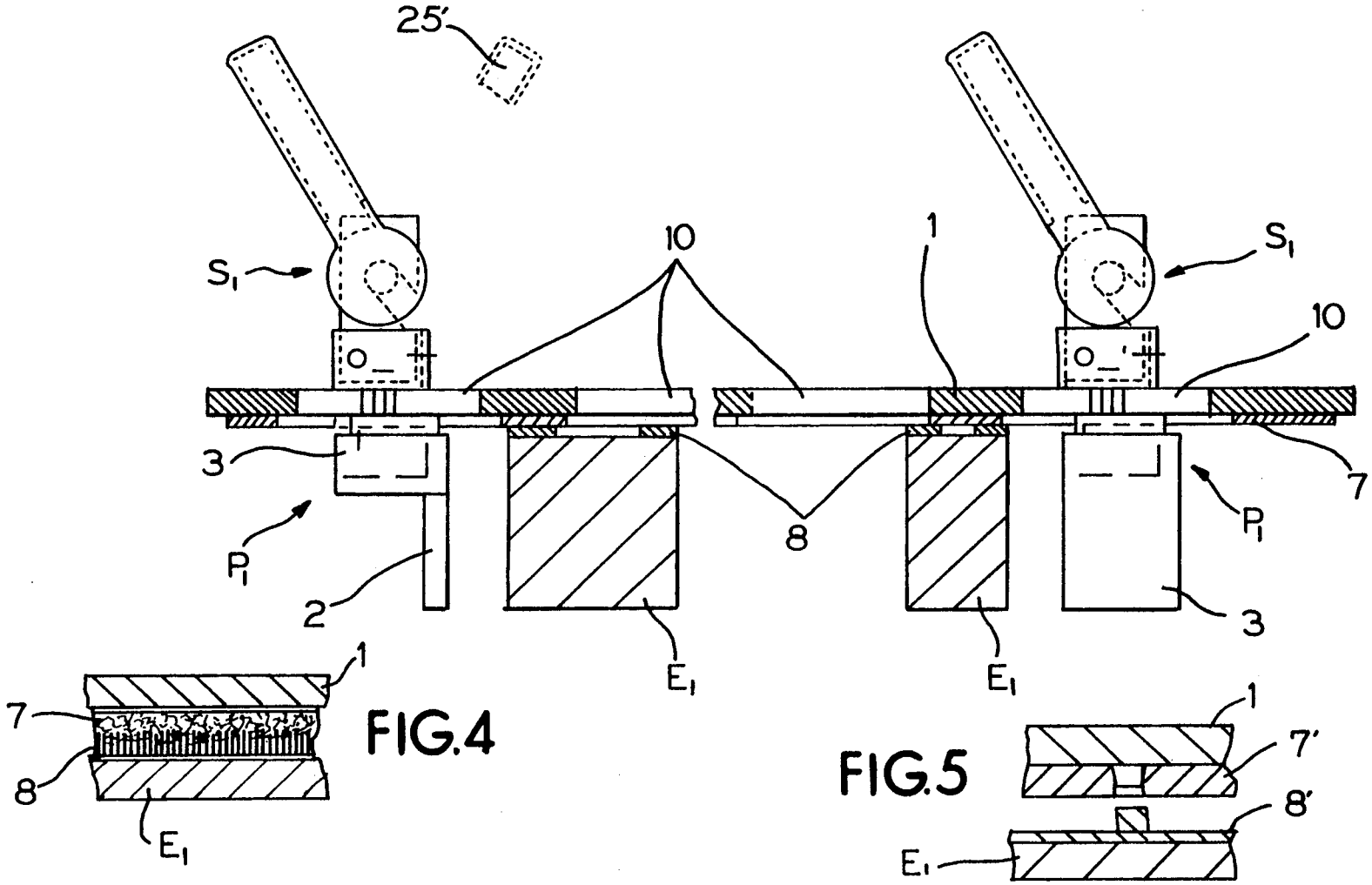
FIG. 1 is a sectional side view of an upper tool incorporating the principles of the present invention.
FIG. 4 is a side sectional view of a first embodiment of a mechanical retaining strip in the form of a hook and loop fastening system.
FIG. 5 is a side sectional view of a second embodiment of a mechanical retaining strip in the form of a frictional locking fastening system.

The upper tool as shown on FIG. 1 consists of a horizontal rectangular plate 1 perforated with oblong apertures 10 arranged on nearly the whole plate's surface. Push-rods $P_1$ (of which only two have been represented on FIG. 1) are fitted in a removable manner against the lower side of the plate 1 by means of quick-fitting means $S_1$ having a handle pivotable to position 25' situated on the upper side of the plate 1 and passing through the apertures 10. The push-rods $P_1$ may either be made of one rectangular block 3 able to pivot along a vertical axle with regard to the fitting means $S_1$, or of a block 3 with a pin 2 fixed to ft (see aforementioned patent CH-A-490943 for further details). The number and the position of the blocks 3 and the pins 2 are chosen so as to be able to push the waste through the lower tool.

Mechanical retaining strips 7, which preferably consist of one of a hook or loop portion of a removable fastener system such as the type sold under the trademark "VELCRO", are arranged and glued on the whole lower surface of the plate 1 (shown in greater detail in FIG. 4). Sponge rubber pressers $E_1$ of a rectangular shape are fitted by means of complementary mechanical retaining strips 8, such as the other of a hook or loop portion, glued on their upper side opposite the strips 7 and in the desired position on the lower side of the plate 1. In order to ease the adherence of the respective strips 7, 8, it has proved preferable that the pressers $E_1$ be provided with relatively narrow strips 8 situated on two opposite edges of their upper supporting surface. In the case of push-rods $P_1$ and of their fitting means $S_1$ represented on FIG. 1, it is preferable that the areas of the lower surface of the plate 1 situated directly in the vicinity of the apertures 10 not be covered with strips 7 so that the rectangular blocks 3 may directly contact the plate 1.

In FIG. 2 the universal upper tool consists of a plate 1' provided with numerous apertures 10' in every one of which a stripping pin 2' can be inserted from above. Each pin 2' is provided at its upper end with a head 9 engageable against the upper side of the plate 1'. A board structure 4, removed for clarity from FIG. 3, placed on the heads 9 during the stripping operation prevents the pins 2' from moving away from the plate 1'. The plate 1' can also be provided with push-rods (not represented) similar to the ones shaped as blocks 3 on FIG. 1. The whole lower surface of the plate 1' can, for example, be covered with a strip 7', engageable with presser strips 8' as described above, applied before the creation of the apertures 10' in order for the strip to be perforated simultaneously with the apertures.

In the case of FIG. 2, a significant spare storing space is obtained since the pins 2' and the pressers $E'_1$, are allowed to be taken off the plate.

During the positioning of the pressers, the use of mechanical retaining strips such as described above allows:

quick, easy and inexpensive fitting of the pressers;

quick and non-destructive dismantling of the pressers, i.e., possibility of reusing them for further jobs; and easy readjustment of a presser already positioned.

Modifications can be added without departing from the framework of the invention. For instance the mechanical retaining strips can be of a frictional locking engagement type (see 7A and 8A in FIG. 5), such as the type sold under the trademark "LEGO".

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim:

1. A universal movable upper tool for a waste-stripping station situated within a machine designed for die-cutting sheet or web-like matter used for producing packages, comprising a support on which stripping push-rods are carried and on which elastic pressers are fitted on the support in laterally adjustable positions by means of complementary mechanical retaining strips applied on every presser and on said support.

2. A universal movable upper tool according to claim 1, in which said support comprises a horizontal plate provided with numerous apertures for receiving said push-rods, said plate having a lower surface against which said pushrods and said pressers are fitted, characterized by said strips being fixed on said lower surface of said plate and on an upper surface of every presser.

3. A universal movable upper tool according to claim 2, in which quick-fitting means are arranged on an upper surface of said plate which are engaged through oblong apertures with said push-rods having a portion abutting areas on said lower surface of said plate, characterized by said strips on said plate being spaced from said abutting areas of said push-rods.

4. A universal movable upper tool according to claim 2, wherein said plate is provided with numerous apertures, each aperture capable of receiving a push-rod shaped as a pin provided at its upper end with a head engageable against an upper surface of said plate, means for locking said pins in position and wherein said strips make up a layer covering principally the whole of said lower surface of said plate.

5. A universal movable upper tool according to claim 1, wherein said complementary mechanical retaining strips comprises a strip of loop material and a strip of hook material which provide releasable engagement therebetween.

6. A universal movable upper tool according to claim 1, wherein said complementary mechanical retaining strips comprises a first strip of material having a predetermined contour and a second strip having a complementary contour, frictionally engageable with said first strip to provide releasable engagement therebetween.

7. A universal movable upper tool according to claim 6, wherein said first strip has a plurality of protrusions and said second strip has a plurality of sockets for frictionally receiving and retainingly engaging said protrusions.

8. A universal movable upper tool for a waste-stripping station situated within a machine designed for die-cutting sheet or web-like matter to be converted into packages, comprising a support on which stripping push-rods and elastic pressers are fitted so as to be shiftable into position, characterized by said pressers being fitted on the support in laterally adjustable positions by means of complementary mechanical retaining strips applied on every presser and on said support.

9. A universal movable upper tool according to claim 8, wherein said complementary mechanical retaining strips comprise a strip of loop material and a strip of hook material which provide releasable engagement therebetween.

10. A universal movable upper tool according to claim 8, wherein said complementary mechanical retaining strips comprise a first strip of material having a predetermined contour and a second strip having a complementary contour, frictionally engageable with said first strip to provide releasable engagement therebetween.

11. A universal movable upper tool according to claim 10, wherein said first strip has a plurality of protrusions and said second strip has a plurality of sockets for frictionally receiving and retainingly engaging said protrusions.

* * * * *